US008259030B2

(12) United States Patent
Hanane et al.

(10) Patent No.: US 8,259,030 B2
(45) Date of Patent: Sep. 4, 2012

(54) ANTENNA OF THE HELIX TYPE HAVING RADIATING STRANDS WITH A SINUSOIDAL PATTERN AND ASSOCIATED MANUFACTURING PROCESS

(75) Inventors: Lamyaa Hanane, Toulouse (FR); Sami Hebib, Toulouse (FR); Hervé Aubert, Toulouse (FR); Nelson Fonseca, Cugnaux (FR)

(73) Assignee: Centre National d'Etudes Spatiales (FR)

( * ) Notice: Subject to any disclaimer, the term of this patent is extended or adjusted under 35 U.S.C. 154(b) by 356 days.

(21) Appl. No.: 12/677,597

(22) PCT Filed: Sep. 11, 2008

(86) PCT No.: PCT/EP2008/062045

§ 371 (c)(1),
(2), (4) Date: Mar. 11, 2010

(87) PCT Pub. No.: WO2009/034125

PCT Pub. Date: Mar. 19, 2009

(65) Prior Publication Data

US 2010/0194665 A1 Aug. 5, 2010

(30) Foreign Application Priority Data

Sep. 11, 2007 (FR) ..... 07 57485

(51) Int. Cl.
*H01Q 1/36* (2006.01)

(52) U.S. Cl. ..... 343/895

(58) Field of Classification Search ..... 343/895, 343/702

See application file for complete search history.

(56) References Cited

U.S. PATENT DOCUMENTS

| | | | | |
|---|---|---|---|---|
| 6,232,929 | B1 * | 5/2001 | Ermutlu et al. | 343/895 |
| 6,424,316 | B1 * | 7/2002 | Leisten | 343/895 |
| 2005/0162334 | A1 * | 7/2005 | Saunders et al. | 343/895 |

FOREIGN PATENT DOCUMENTS

| | | | |
|---|---|---|---|
| EP | 0320404 | A1 | 6/1989 |
| EP | 0920073 | A1 | 6/1999 |
| EP | 1150382 | A1 | 10/2001 |

OTHER PUBLICATIONS

International Search Report for PCT/EP2008/062045 dated Nov. 11, 2008.

Letestu Y et al: A size reduced configurations of printed quadrifilar helix antenna Antenna Technology: Small Antennas and Novel Metamaterials, 2005. IWAT 2005. IEEE International Workshop on Singapore Mar. 7-9, 2005, Piscataway, NJ, USA,IEEE, (Mar. 7, 2005), pp. 326-328, XPO10813142.

* cited by examiner

*Primary Examiner* — Hoang V Nguyen
(74) *Attorney, Agent, or Firm* — Lerner, David, Littenberg, Krumholz & Mentlik, LLP

(57) ABSTRACT

The invention relates to an antenna of the helix type, comprising a plurality of radiating strands wound in a helix in an axisymmetric form (15), characterized in that each radiating strand is made up of at least one reference pattern (MR1, MR2, MR3) defined by an analytic function defined in a reference frame, the axis of the abscissae of which is the director axis of the radiating strands and is a periodic function of (I) or (II) and $A_k$ correspond respectively to the frequency and to the amplitude of the sinusoid of index k.

$$y = A_0 \sin\left(2\pi \frac{x}{T}\right) + \sum_{k=1}^{\infty} A_k \sin\left(2\pi\sigma_k \frac{x}{T}\right) \quad \text{(I)}$$

$$2\pi\sigma_k \frac{1}{T} \quad \text{(II)}$$

16 Claims, 4 Drawing Sheets

ANTENNA OF THE HELIX TYPE HAVING RADIATING STRANDS WITH A SINUSOIDAL PATTERN AND ASSOCIATED MANUFACTURING PROCESS

CROSS REFERENCE TO RELATED APPLICATIONS

The present application is a national phase entry under 35 U.S.C. §371 of International Application No. PCT/EP2008/062045, filed Sep. 11, 2008, published in French, which claims the benefit of French Patent Application No. 0757485, filed Sep. 11, 2007.

GENERAL TECHNICAL DOMAIN

The present invention relates to antennae of helix type. In particular, it relates to antennae of printed quadrifilar helix type. Such antennae apply especially to band L telemetry systems (operating frequency between 1 and 2 GHz, typically around 1.5 GHz) for useful charges of stratospheric balloons.

PRIOR ART

The advantage to antennae of printed helix type is being simple to make and cheap. They are particularly adapted to telemetry signals of band L circular polarisation, signals used in useful charges of stratospheric balloons. They further offer a good rate of ellipticity and therefore good circular polarisation over a wide range of elevation angles.

The patent EP 0 320 404 describes a printed antenna of helix type and its manufacturing process. Such an antenna comprises four radiating strands in the form of metallic bands obtained by removing metallisation material on either side of the bands of a metallised zone of a printed circuit. The printed circuit is intended to be wound in a helix around a cylinder.

These antennae offer good performance but are bulky.

Compact antennae of helix type, comprising radiating strands in the form of a meander have been proposed for reducing the size of antennae of this type.

The article: Y. Letestu, A. Sharaiha, Ph. Besnier "A size-reduced configuration of printed quadrifilar helix antenna", IEEE workshop on Antenna Technology: Small Antennas and Novel Metamaterials, 2005, pp. 326-328, March 2005, describes such antennae.

However, even though a gain of the order of 35% over bulk was obtained, performances, especially in crossed polarisation and rear radiation, are degraded, showing limits to the use of such patterns as to reduction of the size of antennae of this type.

In particular, useful charges of stratospheric balloons require increasingly compact antennae which retain good performance. The antenna of reduced size must retain a radiation diagram, especially in principal polarisation, in keeping with the application in question.

PRESENTATION OF THE INVENTION

The invention aims to reduce the bulk of helix antennae of known type and/or improve conformity of the radiation diagram to the specifications of the application in question by the antenna or at least retain performance equivalent to antennae of greater bulk.

To this end, according to a first aspect the invention relates to an antenna of helix type comprising a plurality of radiating strands wound in a helix according to a winding form.

The antenna of the invention is characterised in that each radiating strand is composed of at least one reference pattern defined by an analytical function defined in a marker whereof the axis of the abscissae is the director axis of the radiating strands and is a periodical function of equation $$y = A_0 \sin\left(2\pi \frac{x}{T}\right) + \sum_{k=1}^{\infty} A_k \sin\left(2\pi\sigma_k \frac{x}{T}\right)$$

where $$2\pi\sigma_k \frac{1}{T}$$

and $A_k$ correspond respectively to the frequency and to the amplitude of the sinusoid of index k.

According to the pattern, such an antenna reduces bulk by more than 30%, particularly the height, while retaining performance equivalent to that of helix antennae of known type of greater bulk, in particular in terms of performance in adaptation and performance in radiation diagram.

Therefore, the antenna of the invention is of reduced bulk while respecting a precise specification in terms of radiation diagram and polarisation purity.

According to the pattern, significant reduction in the size of the antenna is not necessarily obtained. In these cases in particular, the use of reference patterns defined by at least one sinusoid for the radiating strands improves conformity of the radiation diagram to the specifications of the application, for example by adjusting the level of gain in the axis when the principal radiation mode of the antenna is radial.

The reference pattern is superposition of a plurality of sinusoid and is offered especially by an analytical function defined in a marker whereof the axis of the abscissae is the director axis of the radiating strands.

The analytical function is an equation periodic and is taken over one of its periods of length T=1/v. The coefficients $\sigma_k v$ and $A_k$ correspond respectively to the frequency and amplitude of the sinusoid of index k.

The period T corresponds in particular to the period of the sinusoid known as fundamental, that is, having the greatest period. For convenience, we have this sinusoid correspond to the index k=0 and use $\sigma_0=1$ as convention. Therefore, the parameter v corresponds to the frequency of the fundamental sinusoid.

In the particular case where $A_k=0$ for $k \geqq 1$, the reference pattern corresponds to a simple sinusoid.

The radiating strands are obtained by repetition of a reference pattern. The simplest case corresponds to radiating strands defined by a single reference pattern.

The reference pattern can be composed of:

- two sinusoids whereof the amplitude ratio is typically between 0.2 and 2 and whereof the frequency ratio is between 1 and 10;
- three sinusoids whereof the standardised amplitudes relative to that of the fundamental sinusoid are between 0.2 and 2 and whereof the standardised frequencies relative to that of the fundamental sinusoid are between 1 and 10.

Each radiating strand comprises a whole number of reference patterns, typically between 1 and 10.

The radiating strands are each constituted by a determined metallised zone, wound in a helix on the lateral surface of a sleeve, such that the director axis of each strand is distant from the axis of the following strand by a determined distance, defined according to any perpendicular to any director line of the sleeve as the distance between two points, each defined by an intersection between the axis of a strand and a perpendicular to any director line of the sleeve.

The distance between the axis of each strand is equal to the perimeter of the sleeve divided by the number of radiating strands.

The radiating strands are connected on the one hand in short circuit at the level of a first end to a conducting zone and on the other hand at the level of a second end to a supply circuit.

The antenna comprises a printed circuit on which are formed the metallised zones, the circuit being capable of being wound around a sleeve forming a form of winding.

Each radiating strand is obtained by removing material from a metallised zone of the printed circuit on either side of the patterns of the radiating strands.

The winding form is cylindrical or conical.

The radiating strands can be identical and advantageously four in number.

The antenna of the invention can also be integrated in a telemetry system.

According to a second aspect, the invention concerns a manufacturing process of an antenna of helix type, comprising a step during which according to determined zones a plurality of radiating strands intended to be wound in a helix according to a winding form is formed, characterised in that each radiating strand comprises at least one reference pattern defined by an analytical function defined in a marker whereof the axis of the abscissae is the director axis of the radiating strands and is a periodical function of equation $$y = A_0 \sin\left(2\pi \frac{x}{T}\right) + \sum_{k=1}^{\infty} A_k \sin\left(2\pi\sigma_k \frac{x}{T}\right)$$

where $$2\pi\sigma_k \frac{1}{T}$$

and $A_k$ correspond respectively to the frequency and amplitude of the sinusoid of index k.

The manufacturing process further comprises the steps following during which:

- a printed circuit plate with flexible double face in corresponding dimensions for a cylindrical sleeve of given dimensions is cut out;
- a first zone and a second zone intended to contain the radiating strands and a supply circuit respectively are delimited on the printed circuit;
- metallisation is removed at the level of the first zone on a first face of the printed circuit, the metallisation being retained over the whole of the first zone to constitute the reference propagation plane;
- the radiating strands and the upper conducting zone are formed on the second face of the printed circuit, at the level of the first zone, by removing metallisation material on either side of the determined zones, and a conducting zone forming the strip line with the reference propagation plane is formed at the level of the second zone, by removing metallisation material;
- the printed circuit plate is wound on the reference propagation plane side or on the strands radiating on a sleeve side.

PRESENTATION OF FIGURES

Other characteristics and advantages of the invention will emerge from the following description which is purely illustrative and non-limiting and must be considered with respect to the attached figures, in which:

FIG. 1 schematically illustrates in a developed view a helix antenna of known type;

FIG. 2 schematically illustrates a fontal view of a helix antenna of known type;

Figure 3:
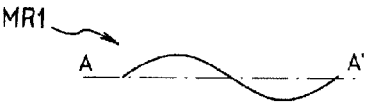
FIG. 3 illustrates a reference pattern composed of a sinusoid.
Figure 4:
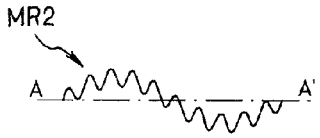
FIG. 4 illustrates a reference pattern composed of the superposition of two sinusoids whereof the frequency ratio is equal to ten.
Figure 5:
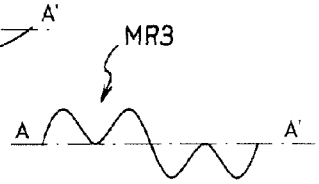
FIG. 5 illustrates a reference pattern composed of the superposition of two sinusoids whereof the frequency ratio is equal to three.
Figure 13:
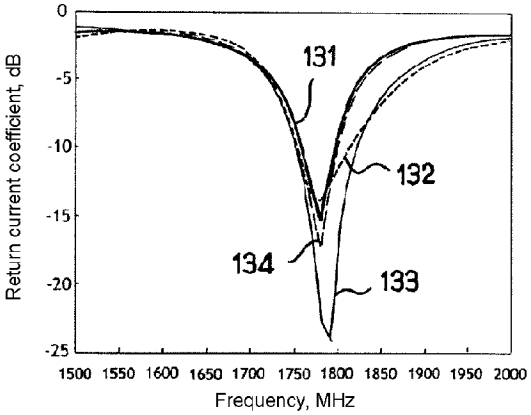
Figure 14B:
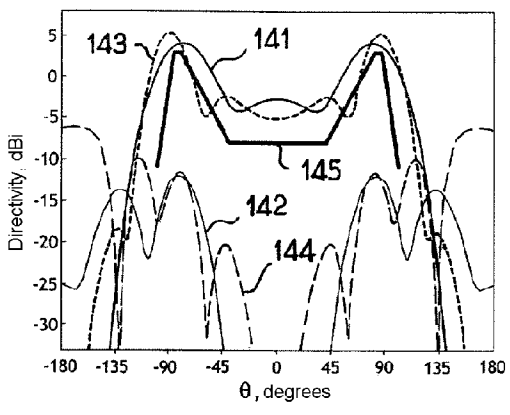
Figure 14C:
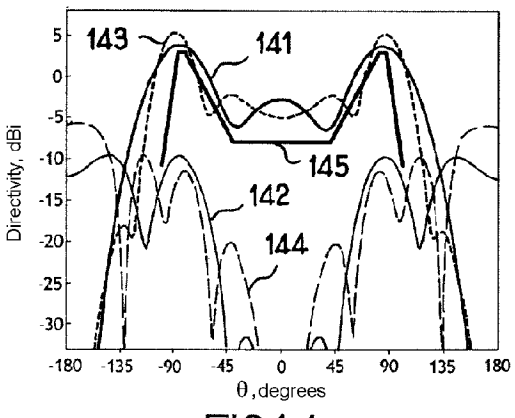
Figure 14A:
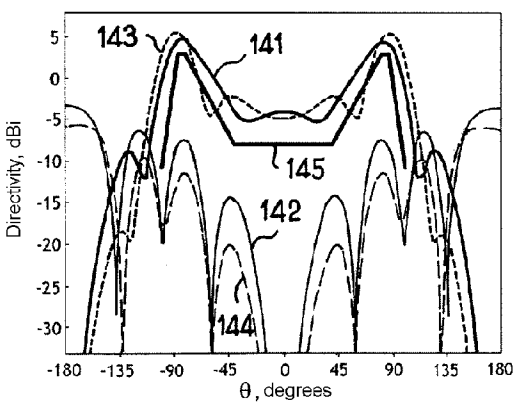

FIGS. 12*a*, 12*b*, 12*c* and 12*d* illustrate steps of the manufacturing process of an antenna according to the present invention;

FIG. 13 illustrates performances in adaptation of a reference antenna and antennae comprising radiating strands obtained with the reference patterns of FIGS. 3, 4 and 5;

FIGS. 14*a*, 14*b* and 14*c* illustrate diagrams of simulated radiation of antennae presented in FIGS. 1, 6, 7 and 8.

DESCRIPTION OF ONE OR MORE EMBODIMENTS AND EXECUTION

Structure of the Antenna

Figure 2:
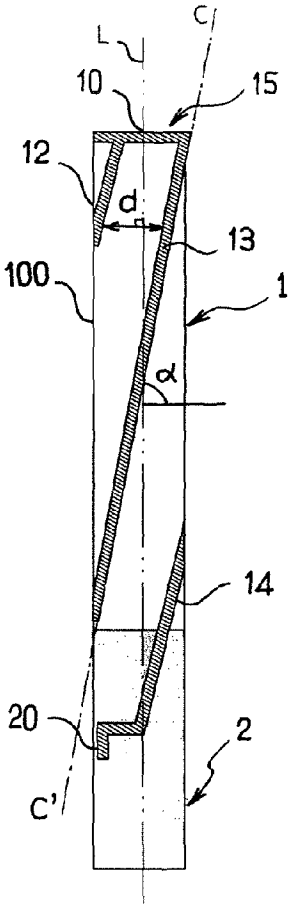
FIG.2 (PRIOR ART)
Figure 1:
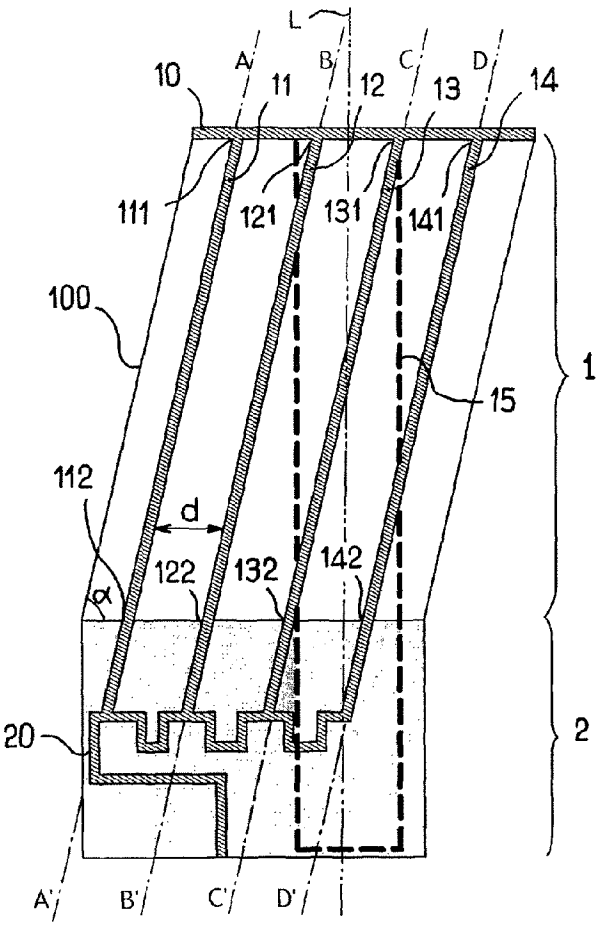
FIG.1 (PRIOR ART)

FIG. 1 illustrates in a developed view a helix antenna and FIG. 2 illustrates a frontal view of a helix antenna.

Such an antenna comprises two parts 1, 2. Part 1 comprises a conducting zone 10 and four radiating strands 11, 12, 13 and 14.

In part 1, the antenna of helix type comprises four radiating strands 11, 12, 13, 14 wound in a helix according to a winding form around a sleeve 15, for example.

In this part, the strands 11-14 are connected on the one hand in short circuit at the level of a first end 111, 121, 131, 141 of the strands at the conducting zone 10 and on the other hand at the level of a second end 112, 122, 132, 142 of the strands to the supply circuit 20.

The radiating strands 11-14 of the antenna can be identical and are for example four in number. In this case, the antenna is quadrifilar.

The sleeve 15 on which the antenna is wound is illustrated in dotted lines in FIG. 1 to constitute the antenna such as shown in FIG. 2.

The radiating strands 11-14 are oriented such that a support axis AA', BB', CC and DD' of each strand forms an angle $\alpha$ relative to any plane orthogonal to any director line L of the sleeve 15.

This angle $\alpha$ corresponds to the helical winding angle of the radiating strands.

The radiating strands 11-14 are each constituted by a metallised zone.

In FIGS. 1 and 2, the metallised zones of the part 1 are symmetrical bands relative to a director axis AA', BB', CC', DD' of the strands.

The distance d between two successive strands is defined according to any perpendicular to any director line L of the sleeve 15 as the distance between two points, each defined as the intersection of said perpendicular with an axis of the strands.

For example, this distance d will be fixed at a quarter of the perimeter of the sleeve 15 to produce a symmetrical quadrifilar antenna.

The substrate supporting the metallic bands is wound in a helix on the lateral surface of the sleeve 15.

According to an embodiment of such an antenna, the two parts 1, 2 are formed on a printed circuit 100.

The radiating strands 11-14 are metallic bands obtained by removing material from each side of the bands of a metallised zone on the surface of the printed circuit 100.

The printed circuit 100 is intended to be wound around a sleeve 15 having a general winding form, such as a cylinder or a cone, for example.

The part 2 of the antenna comprises a supply circuit 20 of the antenna.

The supply circuit 20 of the antenna is constituted by a transmission line of the type strip line in the form of a meander, at the same time ensuring the distribution function of supply and adaptation of the radiating strands 11-14 of the antenna.

The radiating elements are supplied at equal amplitudes with a phase progression in quadrature.

Reduction in size of the antennae of helix type such as illustrated in FIGS. 1 and 2 is obtained by the use of patterns defined by at least one sinusoid.

Patterns

The radiating strands are composed of at least one reference pattern defined by at least one sinusoid.

The reference pattern is obtained in particular by the analytical function, an equation periodical $$y(x) = \sum_{k=0}^{\infty} A_k \sin(2\pi\sigma_k v \cdot x)$$

taken over one of its periods of length T=1/v. The coefficients $\sigma_k v$ and $A_k$ correspond respectively to the frequency and amplitude of the sinusoid of index k. The period T corresponds in particular to the period of the sinusoid called fundamental, that is, having the greatest period. For convenience, we have this sinusoid correspond to the index k=0 and take $\sigma_0=1$ as convention. Therefore, the parameter v corresponds to the frequency of the fundamental sinusoid.

The function defining a reference pattern can be put in the form for $$y = A_0 \sin\left(2\pi\frac{x}{T}\right) + \sum_{k=1}^{\infty} A_k \sin\left(2\pi\sigma_k \frac{x}{T}\right)$$

for $0 \leqq x \leqq T$ defined in a Cartesian marker whereof the axis of the abscissae corresponds to the director axis of the radiating strands AA', BB', CC', DD'.

In general, this expression will be used to superpose 2, or even 3 sinusoids. Beyond that, problems can rise in particular at the level of modelling (excessive number of points defining the structure) and/or of realisation (rapid variations of lines printed incompatible with thicknesses of lines used). This comes back to requiring in general $A_k=0$ for $k \geqq 2$, or even $k \geqq 3$, without all the same excluding particular patterns requiring more sinusoids.

The choice of the pattern as such is guided by radiation performances of the antenna.

This choice is however limited by certain production constraints.

In particular, the amplitude of the sinusoids must not cause overlap between adjacent radiating strands. In the case of a pattern with a single sinusoid, a simple sizing rule is to take $$A_0 \leq \frac{d\sin\alpha}{2}$$

with $\alpha$ being the winding angle in a helix.

As for the number of pattern repetitions, this will be restricted by the thickness of the printed lines and possible problems of coupling between portions of the same radiating strand.

FIG. 3 illustrates a sinusoidal reference pattern MR1 of support axis AA'. In this figure, the pattern is called "simple" and actually is a sinus function over a period.

From superposition of at least two sinusoids, the pattern is called "complex".

FIG. 4 illustrates a reference pattern MR2 defined by superposition of two sinusoids. The reference pattern MR2 of this figure has an amplitude ratio equal to 0.4 and a frequency ratio equal to 10.

FIG. 5 illustrates a reference pattern MR3 defined as the pattern MR2 by superposition of two sinusoids. The reference pattern MR3 of this figure has an amplitude ratio equal to 1 and a frequency ratio equal to 3.

In the case of complex patterns and in particular for patterns defined by superposition of at least two sinusoids, an amplitude ratio will be selected of typically between 0.2 and 2 and a frequency ratio between 1 and 10. Outside these limits, the patterns obtained can cause production problems associated with excessive or insubstantial variations relative to the nature of the line used.

It is noted that the amplitude of the oscillations of the different patterns is regulated such that it is compatible with the thickness of the radiating strands of the antenna.

This amplitude is also selected to avoid problems of overlap between adjacent strands.

There are two possible cases for application of the patterns presented hereinabove.

A first case for which each radiating strand comprises a single reference pattern MR1, MR2 or MR3.

A second case for which each radiating strand comprises repetition of the reference pattern MR1, MR2 or MR3.

Figure 6:
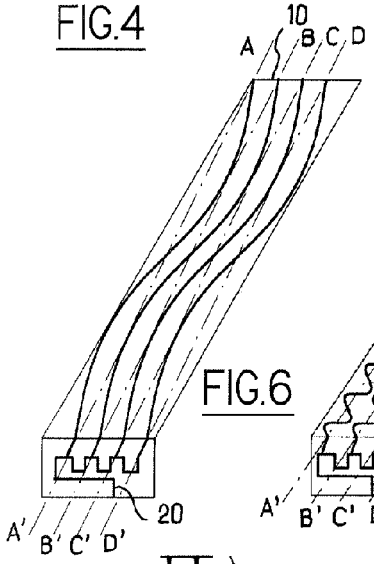
FIG. 6 illustrates in a developed view an antenna of helix type comprising strands obtained with the reference pattern of FIG. 3.

FIG. 6 illustrates in a developed view an antenna of helix type comprising four radiating strands, each defined by the simple reference pattern MR1 of FIG. 3.

Figure 7:
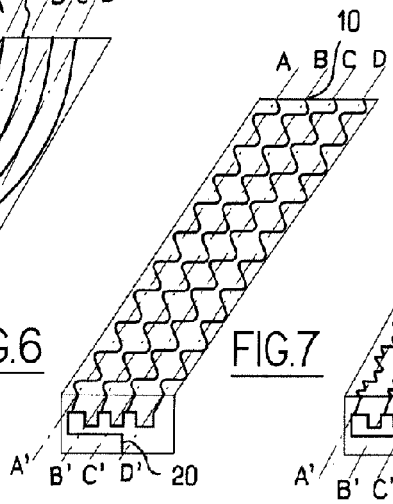
FIG. 7 illustrates in a developed view an antenna of helix type comprising strands obtained with the reference pattern of FIG. 4.

FIG. 7 illustrates in a developed view an antenna of helix type comprising four radiating strands, each defined by ten repetitions of the simple reference pattern MR1 of FIG. 3.

Figure 8:
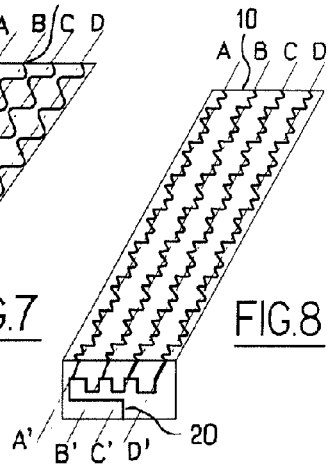
FIG. 8 illustrates in a developed view an antenna of helix type comprising strands obtained with the reference pattern of FIG. 5.

FIG. 8 illustrates in a developed view an antenna of helix type comprising four radiating strands defined by eight repetitions of the complex reference pattern MR2 of FIG. 3.

The use of radiating strands defined by at least one sinusoid reduces the size of the antennae, the strongest reductions being obtained by the use of complex sinusoidal patterns.

This is the case of antennae of helix type illustrated in a developed view in FIGS. 7 and 8.

In some cases, use of radiating strands defined by at least one sinusoid forms the diagram without substantially reducing the height of the helix. This the case of the antenna of helix type illustrated in a developed view in FIG. 6. In this particular case, the sinusoidal pattern improves the form of the radiation diagram to make performances of the antenna compatible with the application in question.

Such patterns for the radiating strands of the antenna "fold" the strands optimally without degrading the performances of the antenna.

For antennae of quadrifilar helix type, the length of the strands fixes the operating frequency of the antenna.

The use of sinusoidal patterns reduces the effective length of the strands while retaining an "unfolded" length comparable to that of an antenna without patterns (strands in the form of metallic bands as illustrated in a developed view in FIG. 1).

The operating frequency of the different antennae is therefore unchanged.

Figure 9:
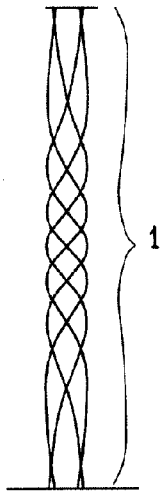
FIG. 9 illustrates the radiating strands wound in a helix obtained with the reference pattern of FIG. 3.
Figure 10:
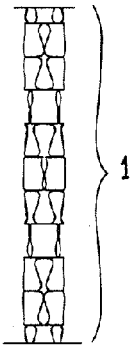
FIG. 10 illustrates the radiating strands wound in a helix obtained with the reference pattern of FIG. 4.
Figure 11:
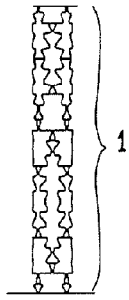
FIG. 11 illustrates the radiating strands wound in a helix obtained with the reference pattern of FIG. 5.
Figure 12A:
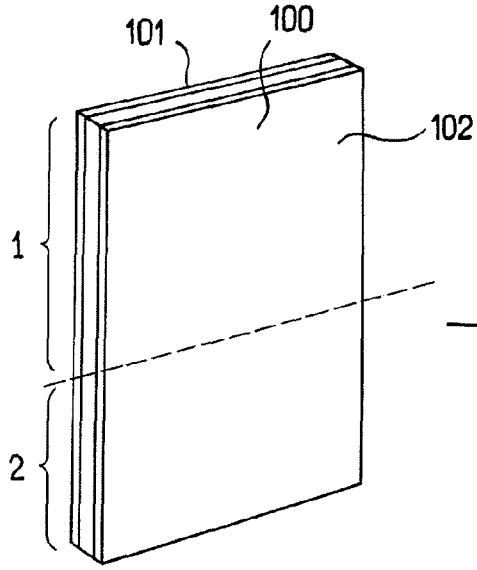
Figure 12B:
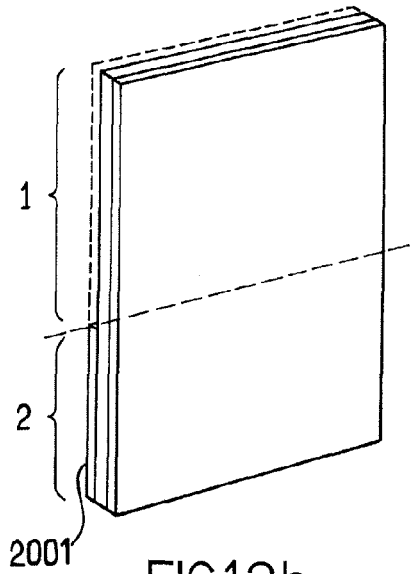
Figure 12C:
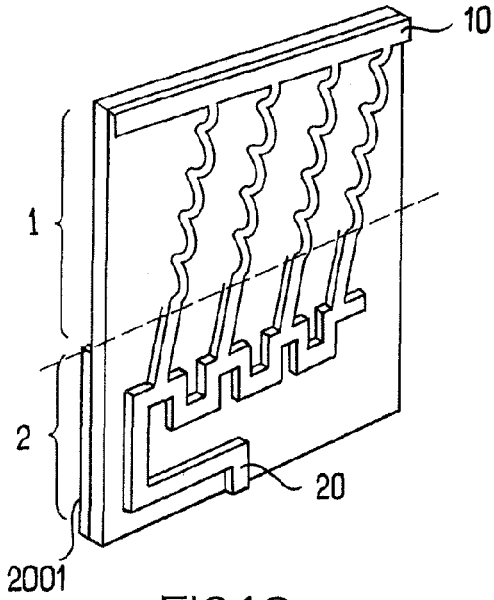
Figure 12D:
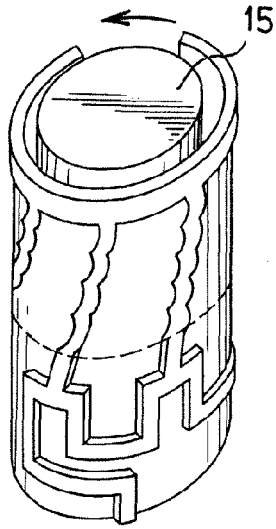

The resulting folding effect is illustrated by FIGS. 9, 10 and 11.

These figures illustrate part 1 of a helix antenna comprising the radiating strands wound in a helix. These are antennae with four strands, known as quadrifilar.

FIG. 9 illustrates an antenna with four radiating strands, each having a pattern defined by the simple sinusoidal pattern MR1. This antenna is the wound representation of the developed version of the antenna of FIG. 6.

FIG. 10 illustrates an antenna with four radiating strands, each having a pattern defined by repetition of the complex sinusoidal pattern MR2. This antenna is the wound representation of the developed version of the antenna of FIG. 7.

FIG. 11 illustrates an antenna with four radiating strands, each having a pattern defined by repetition of the complex sinusoidal pattern MR3. This antenna is the wound representation of the developed version of the antenna of FIG. 8.

A reduction in height of the antenna is evident in these figures.

This reduction can be as much as 40%.

By contrast, the maximum radiation gain of the antenna is generally reduced. The main lobes of the radiation diagram have a larger angular opening.

According to case, a more or less substantial rise in crossed polarisation is noted. But the absolute level remains less than −8 dBi in the worst case, which is acceptable for a good number of applications. Some configurations even have improvement of crossed polarisation as well as rear radiation.

The winding angle in a helix $\alpha$ fixes the number of turns of the helix for a given length of radiating strand and therefore has an impact on the type of radiation diagram, in particular the position of maxima of directivity in principal polarisation.

The higher the number of turns, the more the principal lobes move away from the direction defined by the axis of the helix.

The spacing d between a support axis of one strand and the following is connected with the perimeter of the sleeve 15. In particular, the spacing d is equal to the perimeter of the sleeve divided by the number of strands of the antenna.

From one strand to the other spacing is identical, ensuring a symmetrical radiation diagram.

Production Process

A simple and uncomplicated process is employed to make this type of antenna. Such a process is described in patent EP 0 320 404.

The process especially comprises a step during which a plurality of radiating strands intended to be wound in a helix according to a winding shape is formed according to determined zones.

In addition, each radiating strand is defined by at least one sinusoid.

The process also comprises the following steps.

FIGS. 12*a*, 12*b*, 12*c* and 12*d* illustrate the steps of the process.

A printed circuit plate 100 with flexible double face 101, 102 is cut out to corresponding dimensions for a cylindrical sleeve 15 of given dimensions.

A first zone 1 and a second zone 2 for containing the radiating strands and a supply circuit 20 respectively are delimited on the printed circuit 100.

Metallisation is removed at the level of the first zone on a first face 101 of the printed circuit 100, with metallisation being retained on the entire second zone 102 to constitute the reference propagation plane.

The radiating strands and the upper conducting zone 10 are formed on the second face 102 of the printed circuit 100, by removing material at the level of the first zone on the one hand from metallisation according to the determined zones and on the other hand a conducting zone forming the strip line with the reference propagation plane is formed at the level of the second zone 2.

The printed circuit plate 100 is wound on the reference propagation plane side or on the radiating strands on a sleeve 15 side.

Prototypes

Several prototypes were simulated to validate the antenna structure which has just been described, as antenna A, antenna B and antenna C. Their performances in adaptation and radiation were simulated in particular and compared to those of a quadrifilar reference helix antenna.

In particular, part 1 of the antennae of helix type comprises radiating strands in patterns presented previously.

These strands are connected to the supply circuit of part 2.

The radiating strands having several simple or complex patterns were generated by a code responding specifically to this need. This code in particular fixes the parameters of the different sinusoids to be superposed.

The outputs of the code are the coordinates of points defining the radiating strands either flat for making the mask needed to manufacture the printed circuit or on a cylindrical or conical form as input for commercial electromagnetic simulation software.

To compare performances, the operating frequency is identical between the reference antenna and the antennae having radiating strands in a sinusoidal pattern. To this end, the length of the strands has been adjusted.

Because modelling was carried out using simplified wired models, the width of the printed line was considered via the radius of the wire defining the helix.

The same radius was employed for all helices presented. This parameter could optionally be adjusted to improve the level of adaptation of the helices.

The antennae illustrated in FIG. 6 (antenna A), FIG. 7 (antenna B) and FIG. 8 (antenna C) are compared to a reference antenna such as illustrated in FIGS. 1 and 2, for an operating frequency equal to 1.78 GHz. The input impedance of the antennae is 50Ω.

It is evident that the same sleeve 15 is used for making the reference antenna, antenna A and antenna B and antenna C. The sleeve 15 in question has a diameter equal to 25 mm. The distance between two consecutive strands corresponds to a quarter of the perimeter of the sleeve, notwithstanding the thickness of the substrate supporting the printed strands. For the three antennae analysed, this distance is therefore equal to 19.6 mm.

The table below lists the characteristics of the reference antenna and of the antennae tested.

| | Reference antenna | Antenna A | Antenna B | Antenna C |
|---|---|---|---|---|
| Height (part 1) | 293 mm | 288 mm | 196 mm | 178 mm |
| Resulting reduction | 0% | 1.7% | 33.1% | 39.3% |
| Length of strands used | 329 mm | 329 mm | 351 mm | 329 mm |
| Angle of inclination of strands | 63° | 64° | 54° | 61° |
| Number of turns | 1.90 | 1.79 | 1.84 | 1.28 |

Performances in Adaptation

As already mentioned, the three antennae (A, B and C) in question have been sized to have the same resonance frequency as the reference antenna, specifically 1.78 GHz.

FIG. 13 illustrates the results obtained in adaptation. In this figure, the curves 131, 132, 133 and 134 illustrate performances in adaptation for the antennae A, B, C and reference antennae, respectively.

It is important to note that the present results were all obtained in the same conditions, in particular for the radius of the radiating elements. In fact, this parameter, which adjusts the input impedance of the strands, can be optimised to improve the present levels of adaptation. It is evident that only the natural resonance of the helices, associated with the length of the radiating strands in the first order, was adjusted and is fixed at 1.78 GHz.

It is evident that the antenna A has an adaptation very similar to that of the reference antenna. Likewise, the antennae B and C have greater bandwidth.

Performances in Radiation

FIGS. 14*a*, 14*b* and 14*c* illustrate the diagrams obtained in simulation for antenna A, antenna B and antenna C respectively. For each of these results, the diagrams of antennae A, B and C are compared to the diagram of the reference antenna. In these figures, the curves 141 and 142 illustrate the radiation diagrams the antenna A or B or C in principal polarisation and crossed polarisation respectively, the curves 143 and 144 illustrate the radiation diagrams of the reference antenna in principal polarisation and in crossed polarisation respectively and the curve 145 is a template representing minimal values required in principal polarisation for telemetering application for stratospheric balloons.

It is evident that these diagrams evaluate the impact of patterns on the functioning of the antenna.

For antenna A, the pattern does not really reduce the height of the antenna, but does adapt the radiation diagram to the relevant application. Therefore, for telemetering application on stratospheric balloons, an application for which the reference antenna was designed, it is possible to reduce the nonconformities of the diagram in principal polarisation. On the contrary, a rise in crossed polarisation is noted. The antennae B and C in turn substantially reduce the axial height of the helix. On the contrary, the diagram radiation is modified. In particular, widening of the principal lobes is evident, accompanied by a drop in maximal directivity. The resulting diagrams still remain compatible with the relevant application, meaning that it is possible to complete the same mission using an antenna up to 40% smaller than the standard helix antenna.

In the case of antenna B, an improvement in crossed polarisation is also noted, as well as significant reduction of the rear radiation. The latter phenomenon is also evident on antenna C, though the reduction is less. Such reduction of the rear radiation can be beneficial for overall functioning of the antenna in a given environment, since this reduces interactions and/or perturbations caused by the support (in the case of applications on stratospheric balloons, this would reduce interactions with the nacelle, responsible for more or less significant oscillations on the radiation in principal polarisation).

The invention claimed is:

1. A helical antenna comprising:

a plurality of radiating strands wound in a helix according to a winding form, wherein each radiating strand is composed of at least one reference pattern defined by an analytical function defined in a marker whereof an axis of the abscissae is a director axis of the radiating strands and is a periodical function of the equation $$y = A_0 \sin\left(2\pi \frac{x}{T}\right) + \sum_{k=1}^{\infty} A_k \sin\left(2\pi\sigma_k \frac{x}{T}\right)$$

where T is a period of a sinusoid, k is an index, σ is a coefficient, $0 \leqq x \leqq T$, and where $$2\pi\sigma_k \frac{1}{T}$$

and $A_k$ correspond respectively to a frequency and an amplitude of the sinusoid of index k.

2. The antenna as claimed in claim 1, wherein the analytical function is taken on a length equal to a greatest period of those periods of the sinusoids used to obtain the reference pattern.

3. The antenna as claimed in claim 2, wherein the reference pattern is composed of two sinusoids having an amplitude ratio between 0.2 and 2 and a frequency ratio between 1 and 10.

4. The antenna as claimed in claim 3, wherein the reference pattern is composed of three sinusoids whereof standardised amplitudes relative to the sinusoid having the greatest period are between 0.2 and 2 and standardised frequencies relative to the sinusoid having the greatest period are between 1 and 10.

5. The antenna as claimed in claim 1, wherein each radiating strand comprises a whole number of reference patterns between 1 and 10.

6. The antenna as claimed in claim 1, wherein the radiating strands are each constituted by a determined metallised zone, wound in the helix on a lateral surface of a sleeve, such that the director axis of each strand is distant from the director axis of the following strand by a determined distance, defined according to any perpendicular to any director line of the sleeve as the distance between two points, each defined by an intersection between the director axis of a strand and a perpendicular to any director line of the sleeve.

7. The antenna as claimed in claim 6, wherein the distance between the axis of each strand is equal to the perimeter of the sleeve divided by the number of radiating strands.

8. The antenna as claimed in claim 6, wherein the antenna comprises a printed circuit on which the metallised zones are formed, the circuit being capable of being wound around the sleeve forming the winding form.

9. The antenna as claimed in claim 8, wherein each radiating strand is obtained by removing material from the metallised zone of the printed circuit on either side of the patterns of the radiating strands.

10. The antenna as claimed in claim 1, wherein each of the radiating strands has a first end and a second end, the first ends are connected in short circuit to a conducting zone and the second ends are connected to a supply circuit.

11. The antenna as claimed in claim 1, wherein the winding form is cylindrical or conical.

12. The antenna as claimed in claim 1, wherein the radiating strands are identical.

13. The antenna as claimed in claim 1, wherein the antenna comprises four radiating strands.

14. A telemetry system comprising a helix antenna, the antenna comprising:

a plurality of radiating strands wound in a helix according to a winding form, wherein each radiating strand is composed of at least one reference pattern defined by an analytical function defined in a marker whereof an axis of the abscissae is a director axis of the radiating strands and is a periodical function of the equation $$y = A_0 \sin\left(2\pi \frac{x}{T}\right) + \sum_{k=1}^{\infty} A_k \sin\left(2\pi\sigma_k \frac{x}{T}\right)$$

where T is a period of a sinusoid, k is an index, · is a coefficient, 0·x·T, and where $$2\pi\sigma_k \frac{1}{T}$$

and $A_k$ k correspond respectively to a frequency and an amplitude of the sinusoid of index k.

15. A method of manufacturing helical antenna, the method comprising:

forming a plurality of radiating strands for winding in a helix according to a winding form and according to determined zones, wherein each radiating strand comprises at least one reference pattern;

defining an analytical function in a marker whereof an axis of the abscissae is the director axis of the radiating strands and is a periodical function of the equation $$y = A_0 \sin\left(2\pi \frac{x}{T}\right) + \sum_{k=1}^{\infty} A_k \sin\left(2\pi\sigma_k \frac{x}{T}\right)$$

where T is a period of a sinusoid, k is an index, σ is a coefficient, $0 \leqq x \leqq T$, and $$2\pi\sigma_k \frac{1}{T}$$

and $A_k$ k correspond respectively to the frequency and amplitude of the sinusoid of index k.

16. The process as claimed in claim 15, further comprising the following steps:

fabricating a printed circuit plate with a flexible double face to correspond to the dimensions for a cylindrical sleeve of given dimensions;

delimiting a first zone and a second zone adapted to contain the radiating strands and a supply circuit on the printed circuit;

removing metallisation at a level of the first zone on a first face of the printed circuit;

retaining the metallisation on the entire second zone to constitute a reference propagation plane;

forming the radiating strands and an upper conducting zone on a second face of the printed circuit by removing metallisation material on either side of the determined zones at the level of the first zone, and the upper conducting zone forming a strip line with the reference propagation plane at a level of the second zone; and winding the printed circuit plate on the reference propagation plane side or on the radiating strands on a sleeve side.

* * * * *

UNITED STATES PATENT AND TRADEMARK OFFICE

CERTIFICATE OF CORRECTION

PATENT NO. : 8,259,030 B2
APPLICATION NO. : 12/677597
DATED : September 4, 2012
INVENTOR(S) : Lamyaa Hanane et al.

It is certified that error appears in the above-identified patent and that said Letters Patent is hereby corrected as shown below:

In the Specifications
Column 1, line 40, "form of a meander" should read --form of a meander,--.
Column 2, line 34, "sinusoid" should read --sinusoids--.

In the Claims
Column 11, line 30, "index, · is a" should read --index, is a--.
Column 11, line 37, "and $A_k$k" should read --$A_k$--.
Column 11, line 39, "manufacturing helical" should read --manufacturing a helical--.
Column 12, line 19, "and $A_k$K" should read --$A_k$--.

Signed and Sealed this
Fourth Day of February, 2014

Michelle K. Lee

Michelle K. Lee
*Deputy Director of the United States Patent and Trademark Office*